US007261132B1

(12) United States Patent
Duplessis

(10) Patent No.: US 7,261,132 B1
(45) Date of Patent: Aug. 28, 2007

(54) BASE PLATE CIRCULAR CUTTER

(76) Inventor: Louis A. Duplessis, 15 Royal La., Raymond, NH (US) 03077

( * ) Notice: Subject to any disclaimer, the term of this patent is extended or adjusted under 35 U.S.C. 154(b) by 0 days.

(21) Appl. No.: 11/431,188

(22) Filed: May 9, 2006

(51) Int. Cl.
*B27C 5/10* (2006.01)

(52) U.S. Cl. ..... 144/136.95; 144/48.6; 144/154.5; 409/179

(58) Field of Classification Search ..... 144/136.95, 144/48.6, 154.5, 134.1, 137; 409/179, 180, 409/182; 33/27.03, 27.032, 31
See application file for complete search history.

(56) References Cited

U.S. PATENT DOCUMENTS 2,705,032 A * 3/1955 Pearson ..... 144/154.5
2,972,366 A 2/1961 Caruso
3,376,787 A 4/1968 Morganson
3,478,788 A 11/1969 Zelik
3,635,268 A * 1/1972 Lange ..... 144/154.5
3,858,630 A 1/1975 Cherry et al.
3,934,343 A 1/1976 Witecki
3,967,665 A 7/1976 Lund
4,044,805 A * 8/1977 Gronholz ..... 144/154.5
4,091,713 A 5/1978 Kennedy
4,107,849 A 8/1978 Lettau
4,112,987 A 9/1978 Pachnik
4,147,193 A 4/1979 Kivimaa
4,312,391 A 1/1982 Snow
4,540,320 A 9/1985 Arnold
4,567,927 A 2/1986 Plamann
4,640,324 A * 2/1987 Lounds ..... 144/154.5
4,718,468 A 1/1988 Cowman
4,776,374 A * 10/1988 Charlebois ..... 144/136.95
4,798,506 A 1/1989 Kulp, Jr.
4,815,215 A 3/1989 Saylor et al.
4,905,745 A 3/1990 Jaeger
4,911,214 A 3/1990 Scott
4,913,206 A 4/1990 Altinbasak
5,014,436 A 5/1991 Kozyriski et al.
5,016,354 A * 5/1991 Baine ..... 30/371
5,038,841 A 8/1991 Larmon
5,080,152 A 1/1992 Collins et al.
5,099,727 A 3/1992 Kozyriski et al.
5,231,905 A 8/1993 Trahan
5,289,861 A * 3/1994 Hedrick ..... 144/135.2
5,299,609 A 4/1994 Wedler
5,345,986 A 9/1994 Kieffer
5,398,456 A 3/1995 Kleider
5,486,076 A * 1/1996 Hauschopp ..... 409/179
5,515,611 A 5/1996 Maldonado (Continued)

*Primary Examiner*—Bena Miller
(74) *Attorney, Agent, or Firm*—Bourque and Associates

(57) ABSTRACT

A jig 10 includes a base plate 12 adapted to be secured to a router and is capable of forming circles, ovals, of the like as well as the traditional router functions. The base plate 12 includes a tip aperture 14 sized and shaped to accept a router tip of the router and also includes a channel 16 disposed substantially parallel to a longitudinal face of the base plate 12. A slider 18 is sized and shaped to fit within the channel 16 and move along a longitudinal axis of the channel. A locking mechanism 22 secures the slider 18 to the base plate 12, thereby preventing any longitudinal movement of the slider 18 relative to the base plate 12. The slider 18 optionally includes a pivot peg 20, preferably removably secured within one or more apertures 24 along the length of the slider 18. Alternatively, the slider 18 may include a fence 30 disposed proximate a first end.

19 Claims, 5 Drawing Sheets

U.S. PATENT DOCUMENTS

| | | | |
|---|---|---|---|
| 5,725,038 | A | 3/1998 | Tucker et al. |
| 5,778,949 | A | 7/1998 | Draves |
| 5,899,252 | A | 5/1999 | Pozzo |
| 5,918,524 | A | 7/1999 | Kirby |
| 5,918,652 | A | 7/1999 | Tucker |
| 6,016,854 | A | 1/2000 | Ziegler |
| 6,041,837 | A | 3/2000 | Hanson |
| 6,116,304 | A | 9/2000 | Wilson et al. |
| 6,138,372 | A | 10/2000 | Newman |
| 6,138,726 | A | 10/2000 | Newman |
| 6,176,281 | B1 | 1/2001 | Newman |
| 6,305,447 | B1 | 10/2001 | Rousseau |
| 6,374,878 | B1 | 4/2002 | Mastley et al. |
| 6,378,580 | B1 | 4/2002 | Lovett |
| 6,381,862 | B1 | 5/2002 | Doman |
| 6,415,830 | B1 | 7/2002 | Adamshick |
| 6,481,477 | B1 | 11/2002 | Szymanski et al. |
| 6,523,269 | B1 | 2/2003 | Vincent |
| 6,752,572 | B2 * | 6/2004 | Talesky et al. ..... 409/179 |

* cited by examiner

BASE PLATE CIRCULAR CUTTER

This application claims the benefit of International Application No. PCT/US2004/025380 filed on Aug. 6, 2004 and U.S. Provisional Application No. 60/492,903, filed Aug. 6, 2003.

TECHNICAL FIELD

The present invention relates to routers and more particularly, relates to base plates for routers.

BACKGROUND INFORMATION

There are many ways to cut circles or holes within an object. For example, a circle may be drawn on an object using a compass and then cut using a jigsaw. While this method allows a user to infinitely adjust the diameter of the hole drawn, the accuracy of the hole is limited by the user's ability to follow the hole traced on the surface with the jig saw, and is relatively inaccurate.

Alternatively, one may cut a circle using a drill with a hole cutter bit or the like. This method also suffers from several problems. One problem is that the hole cutter bits are typically made predefined sizes, for example sizes varying by $1/8^{th}$ of an inch. While these predefined bits are generally available for most applications, a problem if the user needs to cut a hole that does not correspond to one of the predefined hole cutter bits sizes. Another problem is that there is a practical limit as to how large of a hole can be cut with a hole cutter bit. For example, if a user wants to cut a hole having a diameter of 3 feet, it is not practical to use a hole cutter bit attached to a drill.

Another method of cutting circles is using a router with a jig attached to the bottom of the router. The jig includes a plurality of holes spaced apart from a center in a predefined pattern. The holes include numbers silk screened onto the upper side of the jig that correspond to the diameter of the hole to be cut. In use, the user first drills a hole in the surface of the object to be cut in the center of the hole. Next, the user places a pivot into the hole of the jig corresponding to the diameter that the user wants to cut, and then rotates the router about the pivot pin and the hole in the object.

This method also suffers from several problems. First, the accuracy of the hole cut is limited to the accuracy of the holes on the jig. As explained above, a user may only cut holes having a diameter corresponding to the diameters listed on the jig. If a hole does not correspond to the exact diameter needed, then the user must chose a diameter either slightly larger or smaller than desired.

Another problem is that the largest hole that the jig may cut is limited by the overall size of the jig. The radius of the largest hole that the jig may cut is proportionate to the distance between the router blade and the hole in the jig. While it is possible to create a very large jig capable of cutting large diameter holes, the jig will become extremely large and awkward to use. As a result, there is a practical limit to the size of the jig and the diameter of holes it is capable of cutting.

Accordingly, what is needed is a method and apparatus for cutting holes and the like in a material (such as, but not limited to, woods, plastic, or metal) that is infinitely adjustable. The method and apparatus should be small, compact, and easy to use, yet capable of cutting both small and large diameter holes accurately and precisely. The method and apparatus should also preferably be capable of cutting holes having a diameter larger than the minimum size of the device.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the following claims.

SUMMARY

The present invention features a jig for use with a traditional router having a router tip. The base plate is adapted to be secured to the router and includes a tip aperture disposed through the base plate sized and shaped to accept the cutter of the router. According to the preferred embodiment, the base plate includes an elongated region, and preferably has a generally oval or elliptical shape.

At least one channel is disposed within the base plate, preferably generally parallel to a longitudinal face of the base plate. At least a portion of the channel is preferably disposed in close proximity to the tip aperture. The channel also preferably includes a generally dove-tail or T shape.

A slider is sized and shaped to fit within the channel and is adapted to move within the channel along a longitudinal axis of the channel. The length of the slider may be adjustable and may include, for example, a telescopic portion. According to one embodiment, the slider includes at least one pivot peg. The slider also preferably includes a plurality of apertures disposed along its length sized and shaped to removably engage the pivot peg. The pivot peg is preferably disposed offset relative to a longitudinal axis of the slider. Alternatively, the slider may include a fence.

The jig also preferably includes a locking mechanism. The locking mechanism secures the slider to the base plate and prevents movement of the slider relative to the base plate. In the exemplary embodiment, the locking mechanism includes a setscrew. Alternatively, the locking mechanism may include a clamp or the like.

BRIEF DESCRIPTION OF THE DRAWINGS

These and other features and advantages of the present invention will be better understood by reading the following detailed description, taken together with the drawings wherein.

DESCRIPTION OF THE INVENTION

Figure 1:
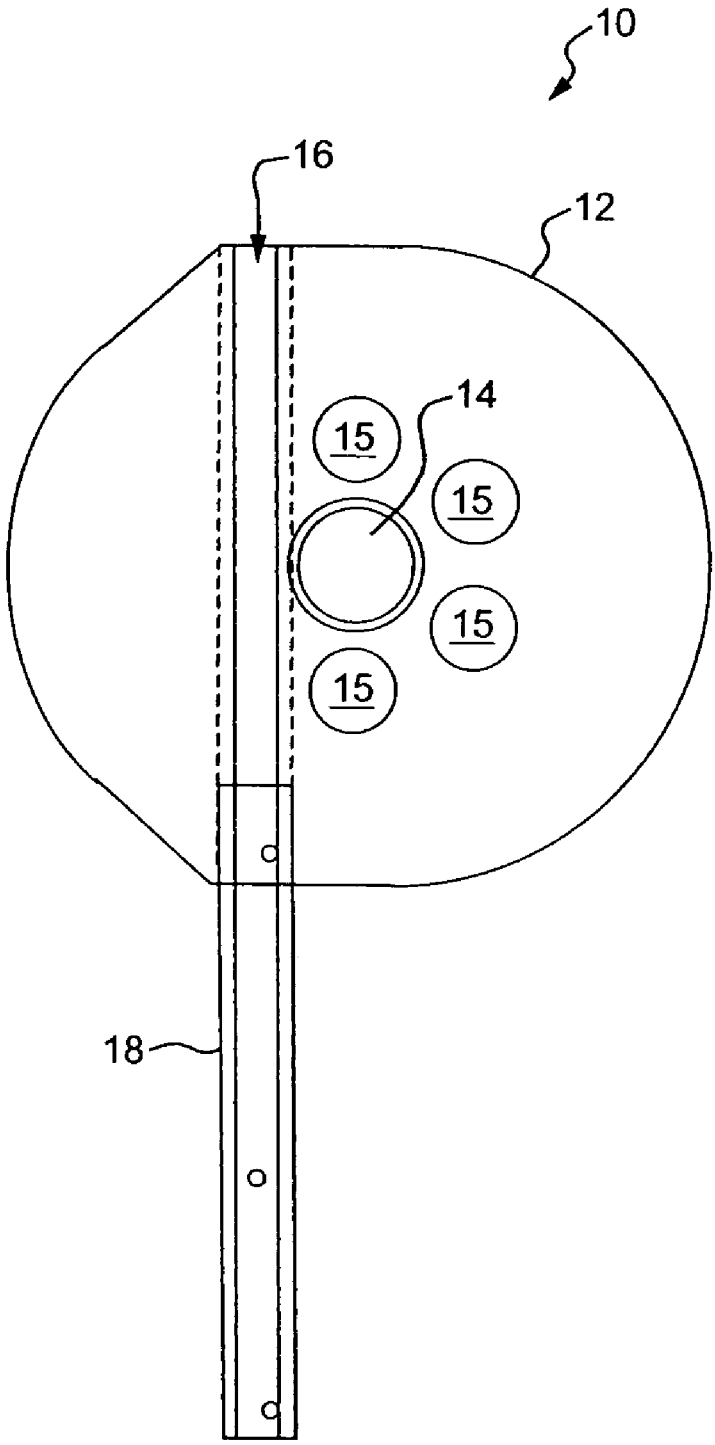
FIG. 1 is top plan view of the circle jig according to the one embodiment of the present invention.

A jig 10, FIG. 1, according to the present invention, is adapted to be mounted to a router (not shown) and replace a traditional base plate. The jig 10 is used to cut holes, ovals, and the like in materials such as, but not limited to, wood, plastic, metal and the like. It is important to note that the jig 10 is capable of cutting holes having a radius that is larger than the minimum diameter of the jig 10 as will be explained in greater detail hereinbelow. It is also important to note that the jig 10 is capable performing substantially all the traditional functions of a router known to those skilled in the art.

The jig 10, hereinafter referred to as the circle jig 10, includes a base plate 12 and a slider 18 adapted to move relative to the base plate 12. The base plate 12 is preferable made of metal or plastic, but may be made of any material known to those skilled in the art having sufficient strength and rigidity. The base plate 12 includes a tip aperture 14 sized and shaped to allow a cutting tip, blade, or cutter (not shown) of the router to fit through the base plate 12 aperture 14. According to the preferred embodiment, the tip aperture 14 includes a notch as is well known in the art. The tip aperture 14 is sized and shaped to accept template bushings (not shown) as is well known to those skilled in the art.

The base plate 12 also includes a channel 16. The channel 16 is sized and shaped to accept the slider 18 such that the slider 18 may be moveable within the channel 16 as will be discussed in greater detail hereinbelow. In the preferred embodiment, the channel 16 is disposed proximate the bottom surface. Alternatively, the channel 16 may be disposed through the center of the base plate or about/proximate the top surface. In the exemplary embodiment, at least a portion of the channel 16 is disposed proximate the tip aperture 14. As will be discussed in greater detail hereinbelow, this arrangement allows the circle jig 10 to cut small diameter holes.

Figure 2:
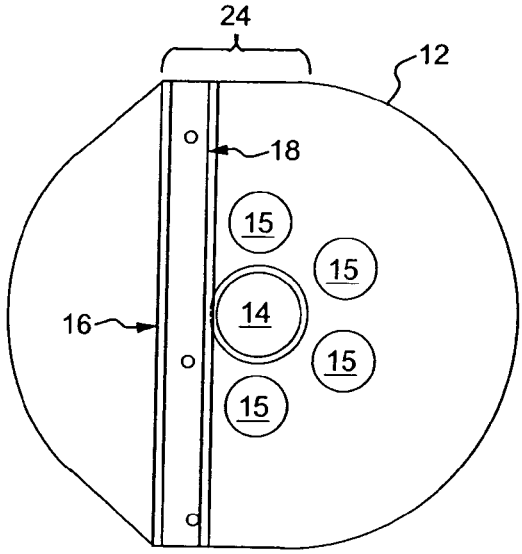
FIG. 2 is a top plan view of the base plate shown in FIG. 1 according to the present invention.
Figure 3:
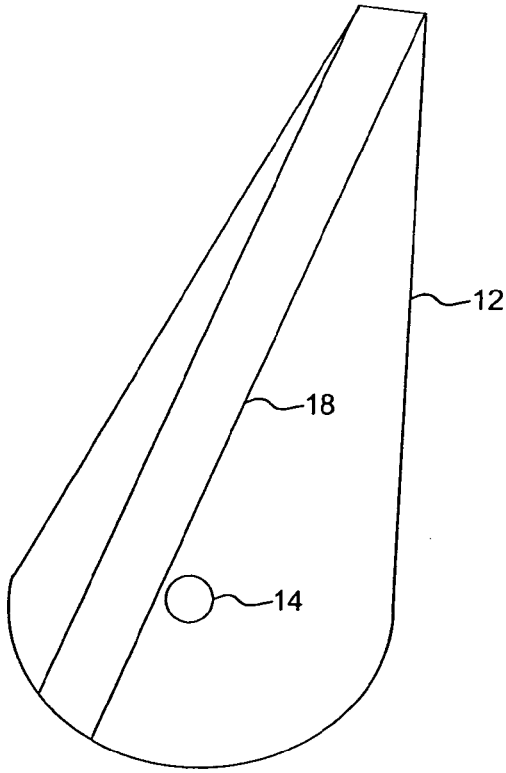
FIG. 3 is a top plan view of another embodiment of the base plate shown in FIG. 1 according to the present invention.

According to the exemplary embodiment, the channel 16, FIG. 2, is disposed within an elongated section 24 in the base plate 12. This elongated section 24 allows the length of the channel 16 to be longer, thereby providing additional support for the slider 18. Consequently, the length of the slider 18 may be increased, thus allowing the circle jig 10 to create larger diameter holes. In an alternative embodiment, the base plate 12, FIG. 3, may have an elongated or tear-drop, elliptical or oval shape such that the length of the channel 16 is increased relative to a standard, traditional router based plate.

Figure 4:
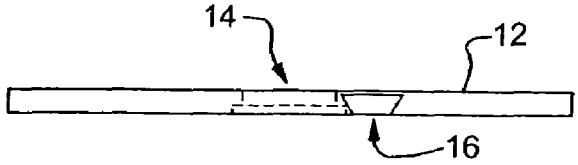
FIG. 4 is a side exploded view of the base plate shown in FIG. 1 according to one embodiment of the present invention.
Figure 5:
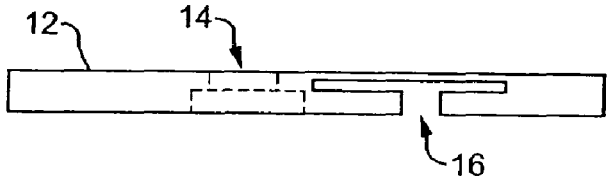
FIG. 5 is a side exploded view of the base plate shown in FIG. 1 according to another embodiment of the present invention.

While the channel 16, FIG. 4, may include virtually any cross-sectional shape, the channel 16 preferable includes a dove tailed cross section such that the channel 16 rigidly locks the slider 18 in place as will be described in greater detail herein below. Alternatively, the channel 16, FIG. 5, may include t-shape or any other shape such that the slider 18 is held in place with respect to the base plate 12. The combination of the channel 16 and slider 18 should be sufficiently rigid and secure to prevent any unwanted and undesirable movement. Optionally, the base plate 12 and/or the slider 18 may include graduations or scales (not shown) such indicating the diameter of the hole to cut.

As shown in FIG. 2, the base plate 12 may optionally include one or more viewing apertures 15 disposed about the tip aperture 14. The viewing apertures 15 allow the user to see the surface being cut beneath the base plate 12. The viewing apertures 15 may be optionally formed from a transparent material such as, but not limited to, transparent plastic or the like.

Figure 6:
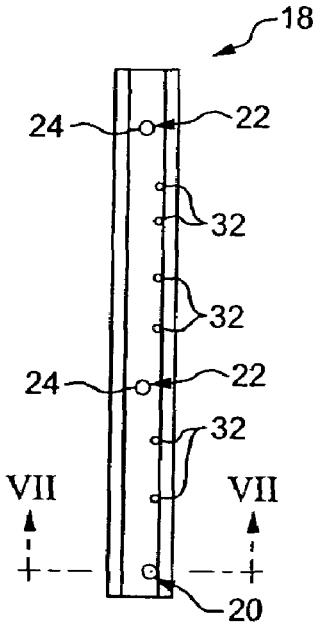
FIG. 6 is a top plan view of one embodiment of the slider shown in FIG. 1 according to the present invention.
Figure 7:
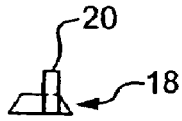
FIG. 7 is a side exploded view of the base plate shown in FIG. 6 along the lines VII according to one embodiment of the present invention.
Figure 8:
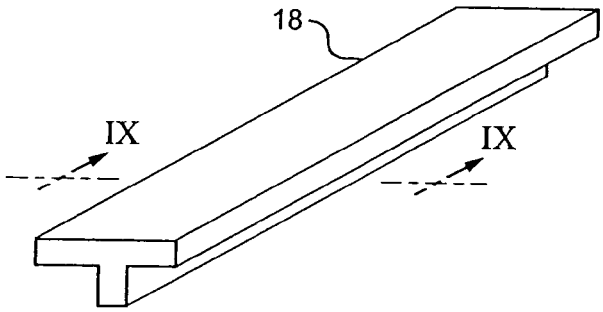
FIG. 8 is a perspective view of another embodiment of the slider shown in FIG. 1 according to another embodiment of the present invention.
Figure 9:
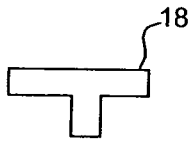
FIG. 9 is an end view of the slider shown in FIG. 8 along the lines IX according to the present invention.

The slider 18, FIG. 1, is size and shaped to fit in the channel 16 as described above. In the preferred embodiment, the slider 18, FIGS. 6-7, has a trapezoidal or triangular shape that fits closely within the dove-tail channel 16 such that transverse movement of the slider 18 relative to the based plate 12 is minimized. Alternatively, the slider 18, FIGS. 8-9, may have a t-shape or any other shape that fits within the channel 16.

The slider 18 may have any length, though as the length of the slider increases, the rigidity of the circle jig 10 may become compromised. As discussed above, the length of the slider 18 may be increased as the length of the channel 16 is also increased. In the preferred embodiment, the slider is between approximately 3.5" to approximately 12", preferably approximately 7", FIG. 6. This dimension allows the base plate 12 to have a generally standard, traditional overall size and shape, and also allows the slider 18 to fit or be stored within the channel 16 of the base plate 12. Storing the slider 18 within the channel 16 is beneficial because it allows the circle jig 10 to perform the same functions as a standard, traditional router base plate. Consequently, the circle jig 10 according to the present invention does not have to be removed unlike known circle devices.

The slider 18 also includes at least one pivot peg or post 20 disposed along the length of the slider 18. In the preferred embodiment, the pivot peg 20 is offset such that the pivot peg 20 is disposed closer to the tip aperture 14 when the slider 18 is disposed within the channel 16. In the exemplary embodiment, the pivot peg 20 maybe removable such that it may be disposed a along the length of the slider 18 at different locations. This allows the user to optimize the position of the slider 18 relative to the base 12 to maximize the overall rigidity of the circle jig 10. Additionally, the moveable pivot peg 20 allows the user to increase or decrease the radius of the hole to be cut. Though not a limitation, the pivot peg 20 is preferably screwed or friction-fitted within apertures 32 along the length of the slider 18.

The slider 18 is secured to the base plate 12 with a locking mechanism 22. In the preferred embodiment, the locking mechanism 22 includes one or more setscrews 24 disposed along the length of the slider 18. When used with a dove-tail or "T" shaped channel 16/slider 18 arrangement, the setscrews 24 secure the slider 18 within the channel 16 by forcing the slider 18 against the walls of the channel 16. The setscrews 24 may be adjusted either from the bottom or the top of the base plate 12. Alternatively, a clamp (not shown) or any other mechanism known to those skilled in the art may be used to secure the slider 18 within the channel 16 relative to the base plate 12.

Figure 10:
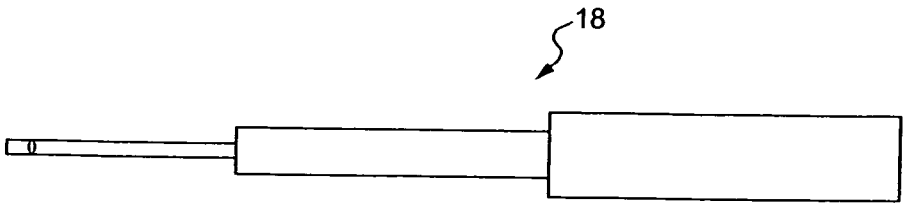
FIG. 10 is a top plan view of another embodiment of the slider shown in FIG. 1 according to the present invention.

In another embodiment, the slider 18, FIG. 10, may telescope in and out with respect to the base plate 12. The slider 18, according to this embodiment, would also include a locking mechanism to secure the length of the slider 18.

This embodiment would allow the circle jig 10 to cut large diameter holes while minimizing the overall size of the circle jig 10.

Figure 11:
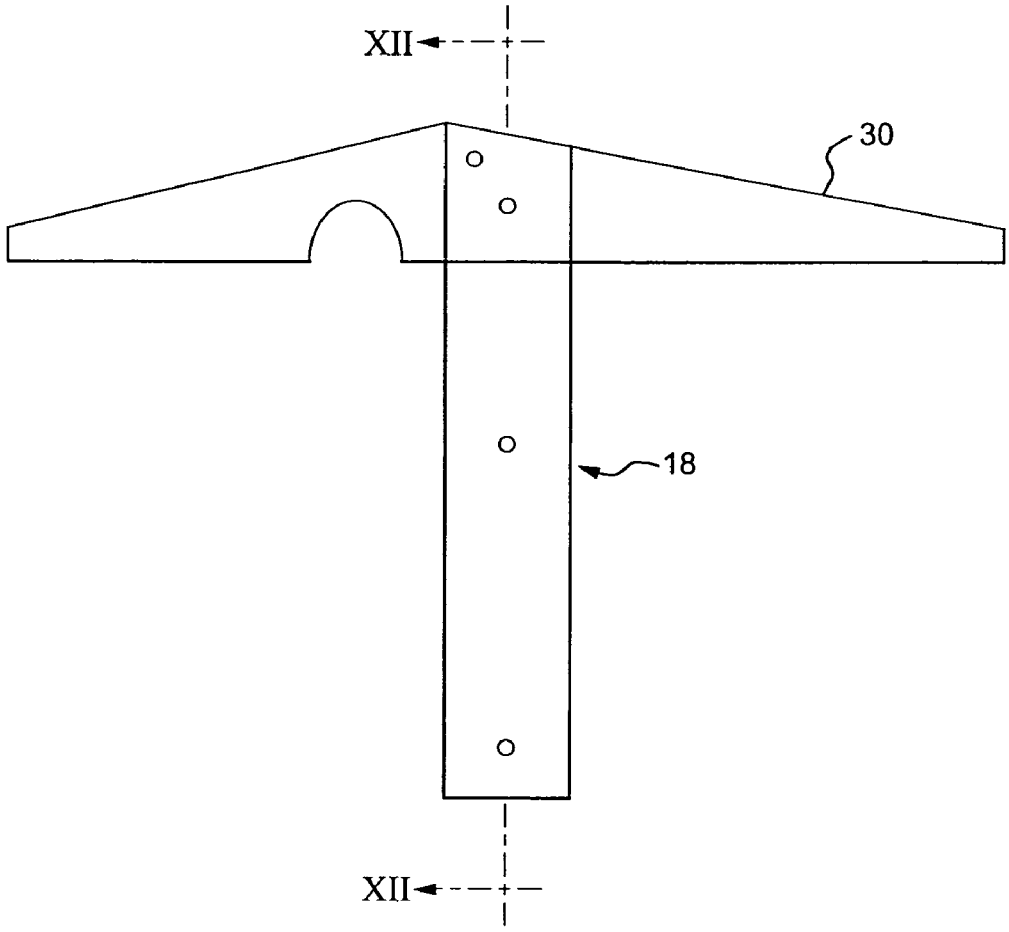
FIG. 11 is a top plan view of yet another embodiment of the slider shown in FIG. 1 according to the present invention.
Figure 12:
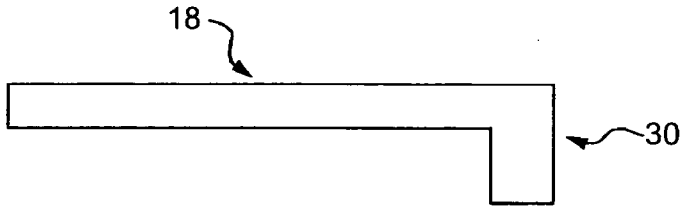
FIG. 12 is a slide plan view of the slider shown in FIG. 11 taken along the lines XII according to the present invention.

In yet another embodiment, the slider 18, FIGS. 11-12, may optionally include a fence 30. The fence slider 30 allows a user to cut a straight line as is well known to those skilled in the art. The fence 30 is preferably removably secured to the slider 18. Alternatively, the fence 30 may be an integral, one-piece unit with the slider 18. In any event, the user inserts the slider 18 portion having the fence slider 30 at one end into the channel 16 of the base plate 12. Thus, the circle jig 10 according to the present invention may remain secured to the router while performing a multitude of tasks, thus minimizing the labor and time necessary to perform multiple tasks.

In practice, a user cuts a hole in a surface by first drills a pilot hole in the center of the surface where the hole is to be cut. Next, the user adjusts the slider 18 such that the distance between the pivot pin 20 disposed on the slider 18 and the router tip or blade corresponds to the radius of the hole to be cut. Because the slider 18 may be infinity adjusted, the user may cut a hole with nearly perfect accuracy. Additionally, since the slider 18 may be extended beyond the outer surface of the base plate 12, the circle jig 10 is capable of cutting hole having a radius larger than the diameter of the base plate 12, without the need for large, bulky, and difficult to use jigs or without having to change the base plate. Once the slider 18 is adjusted, the user simply inserts the pivot pin 20 within the pilot hole and begins to cut the hole by rotating the router in a circular pattern around the pilot hole until the hole is cut.

As mentioned above, the present invention is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with breadth to which they are fairly, legally and equitably entitled.

The invention claimed is:

1. A jig comprising:

a base plate, said base plate configured to be secured to a handheld router and for movement with said router when said router is in use;

a tip aperture disposed through said base plate, said tip aperture sized and shaped to accept at least one router tip of said router;

at least one channel disposed within said base plate substantially parallel to a longitudinal face of said base plate, said at least one channel having a first and a second opening disposed along an outer edge of said base plate, wherein at least a portion of said channel is disposed in close proximity to and offset laterally from said tip aperture and extending from a first side of said base plate to a second side of said base plate opposite from said first side; and a slider sized and shaped to fit within said at least one channel, said slider adapted to move within said channel.

2. The jig as claimed in claim 1 wherein said slider further includes at least one pivot adapted to be secured to said slider.

3. The jig as claimed in claim 2 wherein said at least pivot is adapted to be disposed offset relative to a longitudinal axis of said slider.

4. The jig as claimed in claim 2 wherein said at least at least one pivot is adapted to be removably secured within a plurality of apertures disposed within said slider.

5. The jig as claimed in claim 1 wherein at least a portion of said channel is disposed substantially tangentially to said tip aperture.

6. The jig as claimed in claim 5 wherein said channel and said slider form a generally dove-tail arrangement.

7. The jig as claimed in claim 5 wherein said channel and said slider form a generally T-shaped arrangement.

8. The jig as claimed in claim 5 wherein said base plate further includes an elongated section, wherein at least a portion of said channel is disposed through said elongated section.

9. The jig as claimed in claim 8 wherein said base plate includes a generally elliptical shape.

10. The jig as claimed in claim 1 further including a locking mechanism, said locking mechanism securing said slider relative to said base plate.

11. The jig as claimed in claim 10 wherein said locking mechanism includes a setscrew.

12. The jig as claimed in claim 10 wherein said locking mechanism includes a clamp.

13. The jig as claimed in claim 1 wherein said slider further includes a fence disposed proximate a first end region.

14. The jig as claimed in claim 1 wherein said slider telescopically extendable such that a length of said slider is adjustable.

15. A jig for use with a handheld router having a router tip, said jig comprising:

a base plate configured to be secured to said handheld router and for movement with said router when said router is in use, said base plate having a top and a bottom longitudinal face;

a tip aperture disposed through said top and said bottom longitudinal face of said base plate, said tip aperture sized and shaped to accept said router tip of said router;

at least one channel disposed within said base plate generally parallel to said bottom longitudinal face of said base plate, said at least one channel having a first and a second opening disposed about an outer edge of said base plate wherein said at least one channel forms a passageway through said base plate, said at least one channel disposed in close proximity to and offset laterally from said tip aperture and extending from a first side of said base plate to a second side of said base plate opposite from said first side;

a slider sized and shaped to fit within said at least one channel, said slider adapted to move within said channel; and a locking mechanism, said locking mechanism adapted to secure said slider relative to said base plate.

16. The jig as claimed in claim 15 wherein said slider further includes at least one pivot adapted to be secured to said slider.

17. The jig as claimed in claim 15 wherein said locking mechanism includes a setscrew.

18. The jig as claimed in claim 15 wherein said slider further includes a fence disposed proximate a first end region.

19. A jig for use with a router having a router tip, said circle jig comprising:

a base plate configured to be secured to said router and for movement with said router when said router is in use, said base plate having a top and a bottom longitudinal face;

a tip aperture disposed through said top and said bottom longitudinal face of said base plate, said tip aperture sized and shaped to accept said router tip of said router;

at least one channel disposed within said base plate generally parallel to said bottom longitudinal face of said base plate, wherein said at least one channel includes a first and a second opening disposed about an outer edge of said base plate and wherein at least a portion of said channel is disposed in close proximity to and offset laterally from said tip aperture, said at least one channel extending from a first side of said base plate to a second side of said base plate opposite from said first side;

a slider sized and shaped to fit within said at least one channel, said slider adapted to move within along a longitudinal axis of said channel; and a locking mechanism, said locking mechanism adapted to secure said slider relative to said base plate.

* * * * *